US006592463B1

(12) United States Patent
Gnezdilov

(10) Patent No.: US 6,592,463 B1
(45) Date of Patent: Jul. 15, 2003

(54) SIDESHOW ATTRACTION

(76) Inventor: Vladimir A. Gnezdilov, 36-1 Pyatnitskoe, Shosse, Apt. 43, Moscow 123310 (RU)

( * ) Notice: Subject to any disclaimer, the term of this patent is extended or adjusted under 35 U.S.C. 154(b) by 0 days.

(21) Appl. No.: 09/958,986

(22) PCT Filed: Nov. 10, 1999

(86) PCT No.: PCT/RU99/00375

§ 371 (c)(1),
(2), (4) Date: Mar. 6, 2002

(87) PCT Pub. No.: WO01/26764

PCT Pub. Date: Apr. 19, 2001

(51) Int. Cl.[7] ..... A63G 31/10
(52) U.S. Cl. ..... 472/131; 472/49
(58) Field of Search ..... 472/2, 49, 50, 472/131; 104/53, 77, 78

(56) References Cited

U.S. PATENT DOCUMENTS 6,083,111 A * 7/2000 Moser et al. ..... 472/131
6,158,354 A * 12/2000 Eiraku ..... 104/53

* cited by examiner

*Primary Examiner*—Kien T. Nguyen
(74) *Attorney, Agent, or Firm*—I. Z. Borovsky

(57) ABSTRACT

An amusement ride has a plurality of cars, a unit for guiding the cars in a substantially vertical direction so that the cars are liftable and lowerable, a passenger seat provided in each of the cars, and a unit for cooperating the passenger seat with a respective one of the cars so that the seat is freely moving in a non-motorized way relative to the car whereby a user sitting in the seat obtains a plurality of inclined positions relative to a respective one of the cars.

7 Claims, 10 Drawing Sheets

SIDESHOW ATTRACTION

FIELD OF INVENTION

The invention relates to amusement devices, in particular, to free-fall towers.

PREVIOUS ART

A known amusement ride comprises vertical guide elements for at least one car with passenger seats, a hoisting and a braking devices (see U.S. Pat. No. 5,628,690 of 13.05.97). The afore said ride is a tower which creates a free fall effect and does not allow to diversify the sensations experienced by the riders. Moreover, the human body, the spine in particular, is subjected to substantial G-loads caused by the stationary vertical passenger positioning.

SUMMARY OF THE INVENTION

The engineering object of the invention is to create an amusement ride with a free-fall effect, which features various entertainment effects and enhances the safety of passengers.

The said engineering object is achieved by the following: in the amusement ride containing vertical guide elements for at least one car with passenger seats, a hoisting and a braking devices, at least part of the passenger seats on at least one car are mobile fastened, and the vertical guide elements are made rectil near and/or curvilinear in the projection onto at least one vertical plane.

The said mobile fastening of the passenger seats can be made hinged in the shape of a hinge-lever mechanism or using guides linked to the car. Passenger seats may also be pivoted on an axis perpendicular to the longitudinal axis of the guide elements.

In addition the ride may comprise at least two cars, on at least one of which passenger seats are mobile fastened, some or all of them being additionally connected to the car frame by a return device.

Such a design provides at least three types of seats fastening on one or several cars: rigid fastening, mobile fastening, and mobile fastening with a return device.

The vertical guide elements can be produced as interlinked towers, each supporting at least one car with one type of seats fastening, which also provides diversity of entertainment effects.

The guides can be made curvilinear or/and rectilinear (vertical), including a hinged guide connection with the car, the return device containing elastic elements fastened on the car and respectively connected with the indicated guides and passenger seat.

The hinge-lever mechanism can be produced as a lever, and the return device can be created by the elastic elements fastened on the lever and respectively connected with the car and passenger seat; or the hinge-lever mechanism may be created by two levers, one of which is connected directly to the passenger seat and the other—through the intermediate hinged link, the return device being connected to the said second lever.

At present all free-fall rides feature strictly vertical towers with rectilinear guide elements (see U.S. Pat. No. 5,628,690 of 13.05.97), which restricts their functional capabilities, i.e., they fail to provide a variety of thrills.

A further engineering objective of the invention is to create a tower-type free-fall ride which makes it possible to provide a variety of thrills.

That objective is attained by combining the above plurality of passenger seats fastening versions and making the guide elements curvilinear in the projection onto at least one vertical plane.

The indicated combination of the structural ride elements execution actually provides an unlimited number of amusement effects.

PREFERRED EMBODIMENTS OF THE INVENTION

Figure 1:
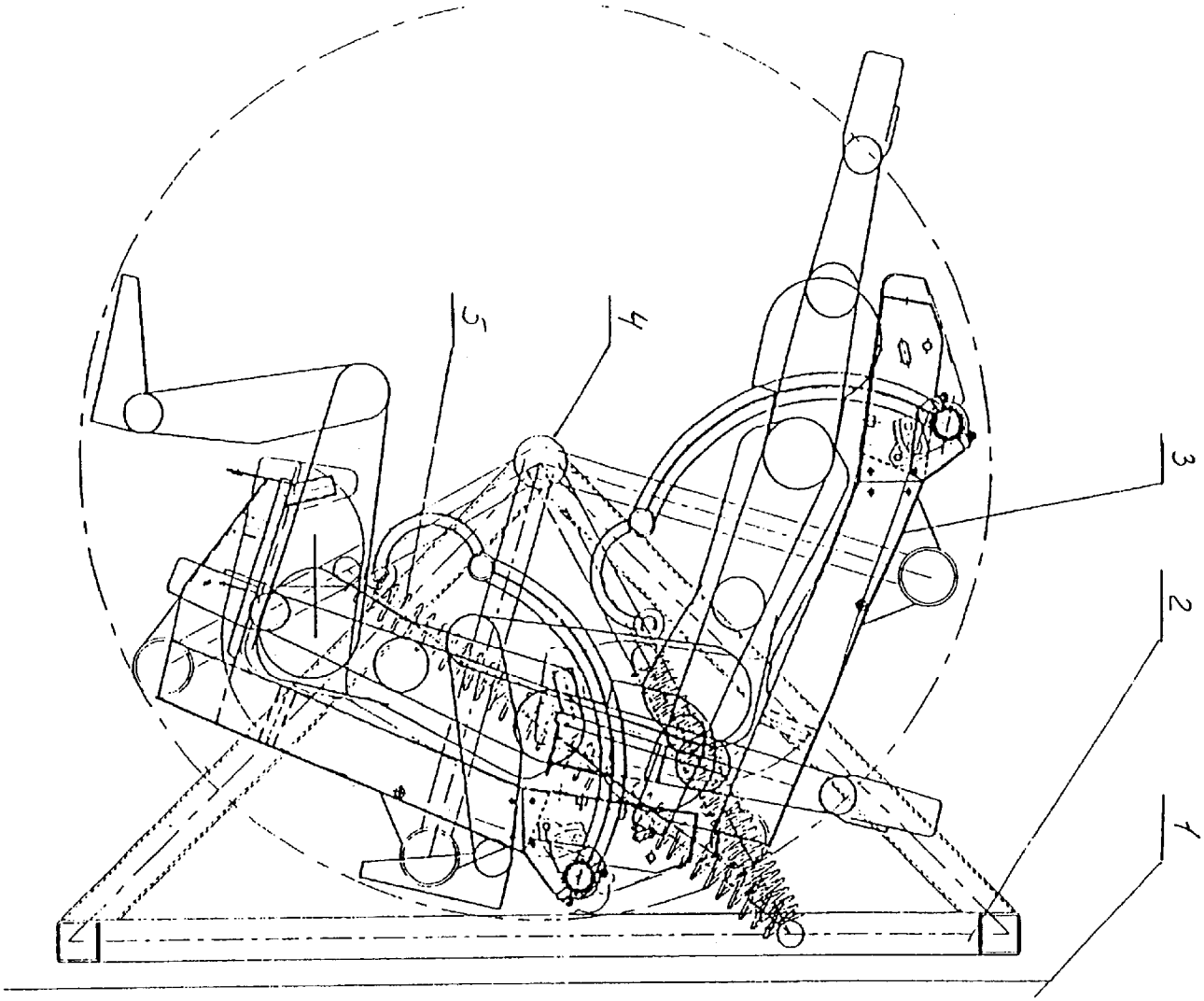
FIG. 1 shows a vehicle with different positions of the seats in the course of its movement along the guide elements, FIG. 2 Ride with different seats fastening on the car.
Figure 2:
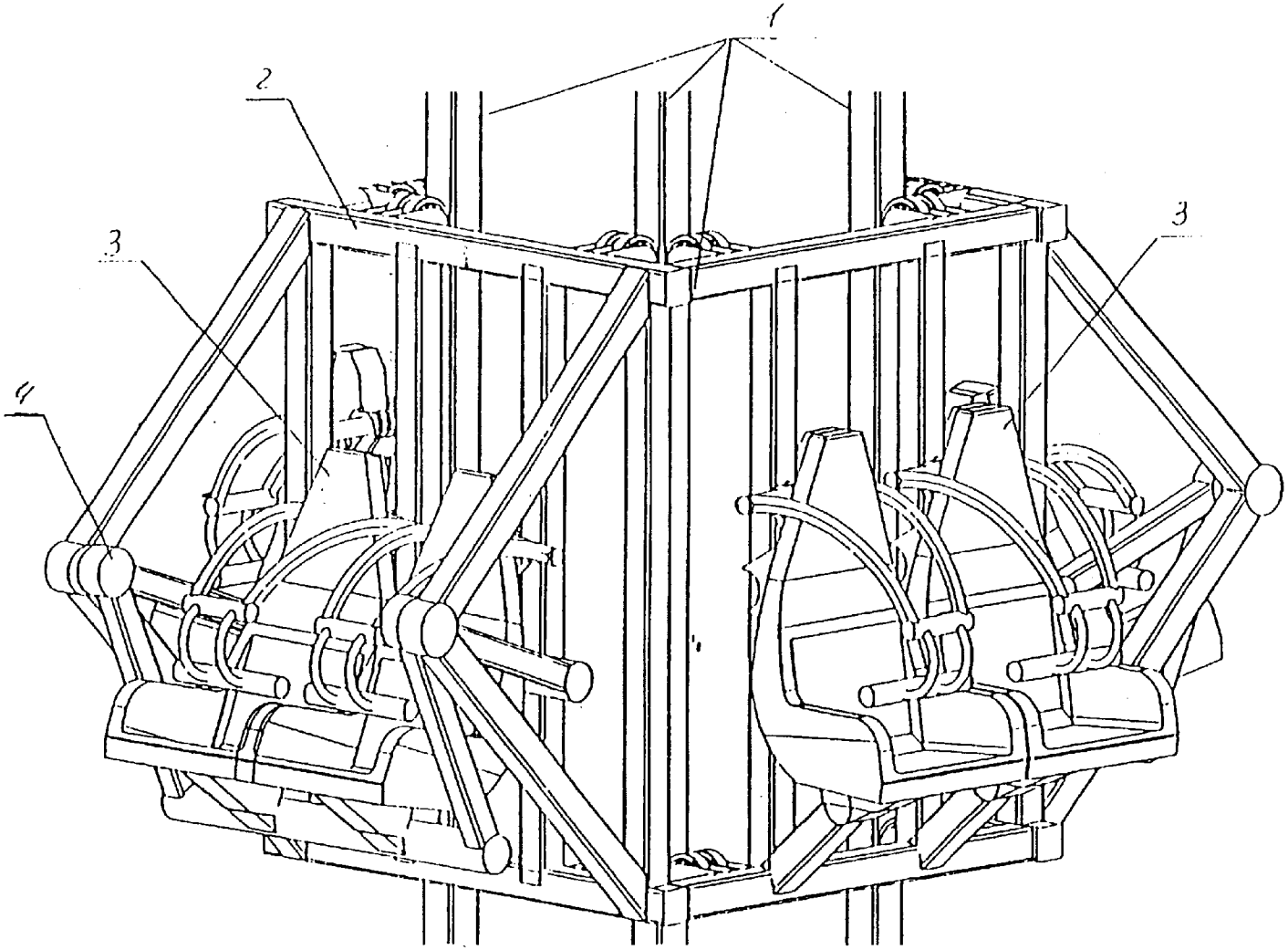
Figure 3:
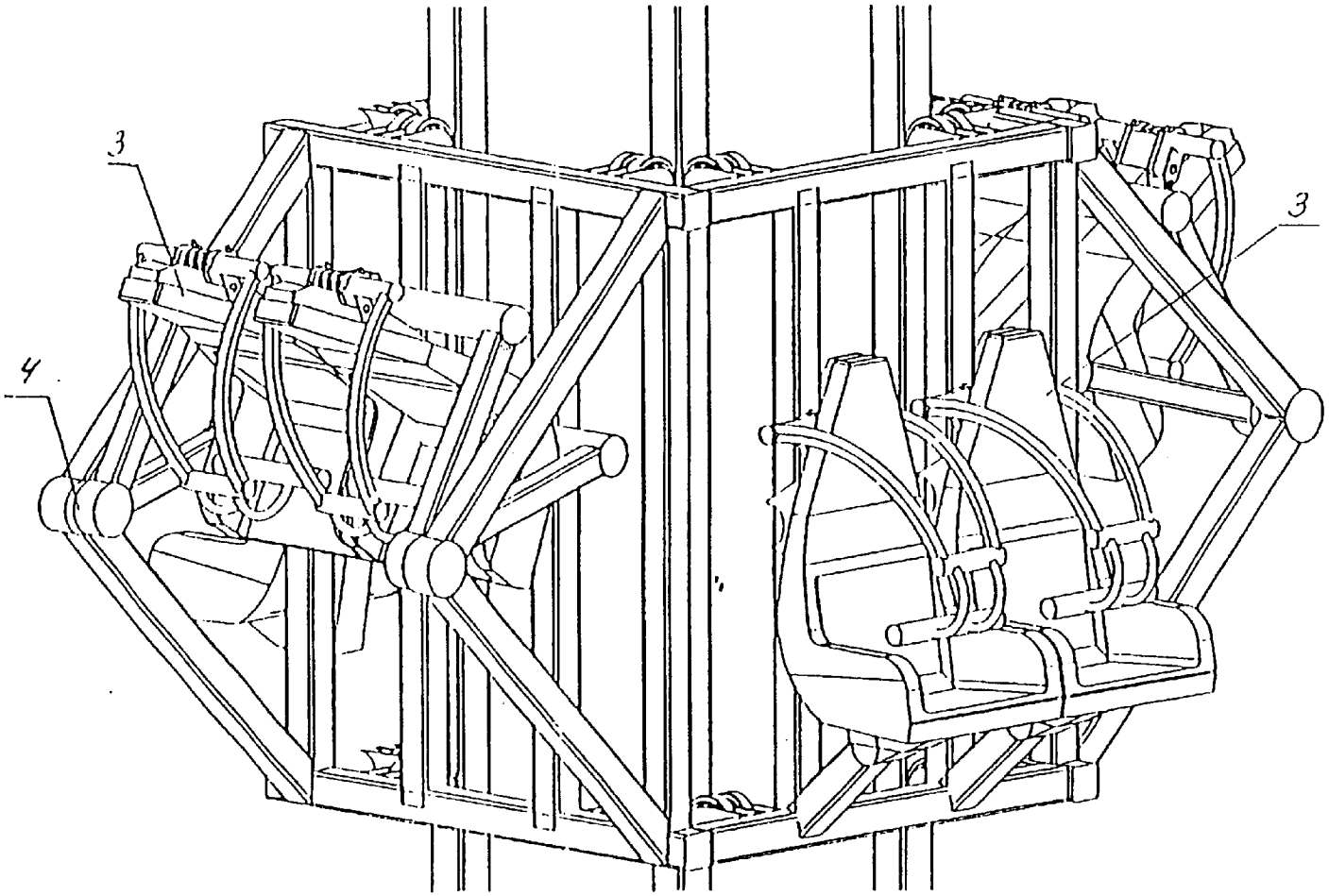
FIG. 3 Positioning of passenger seats with different fastening in the course of movement.
Figure 4:
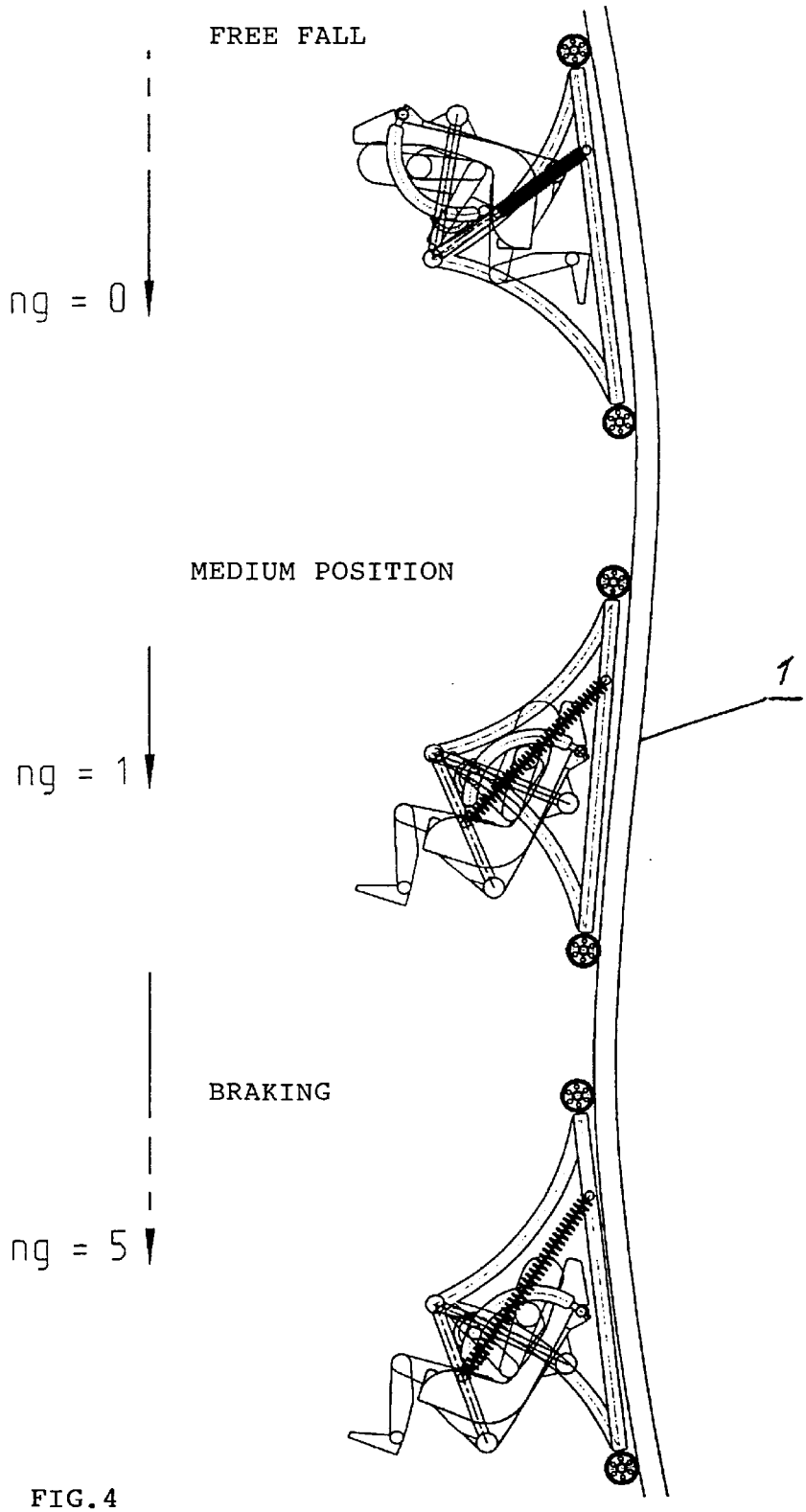
FIG. 4 Positioning of the passenger seat when a hinged connection is used.
Figure 5:
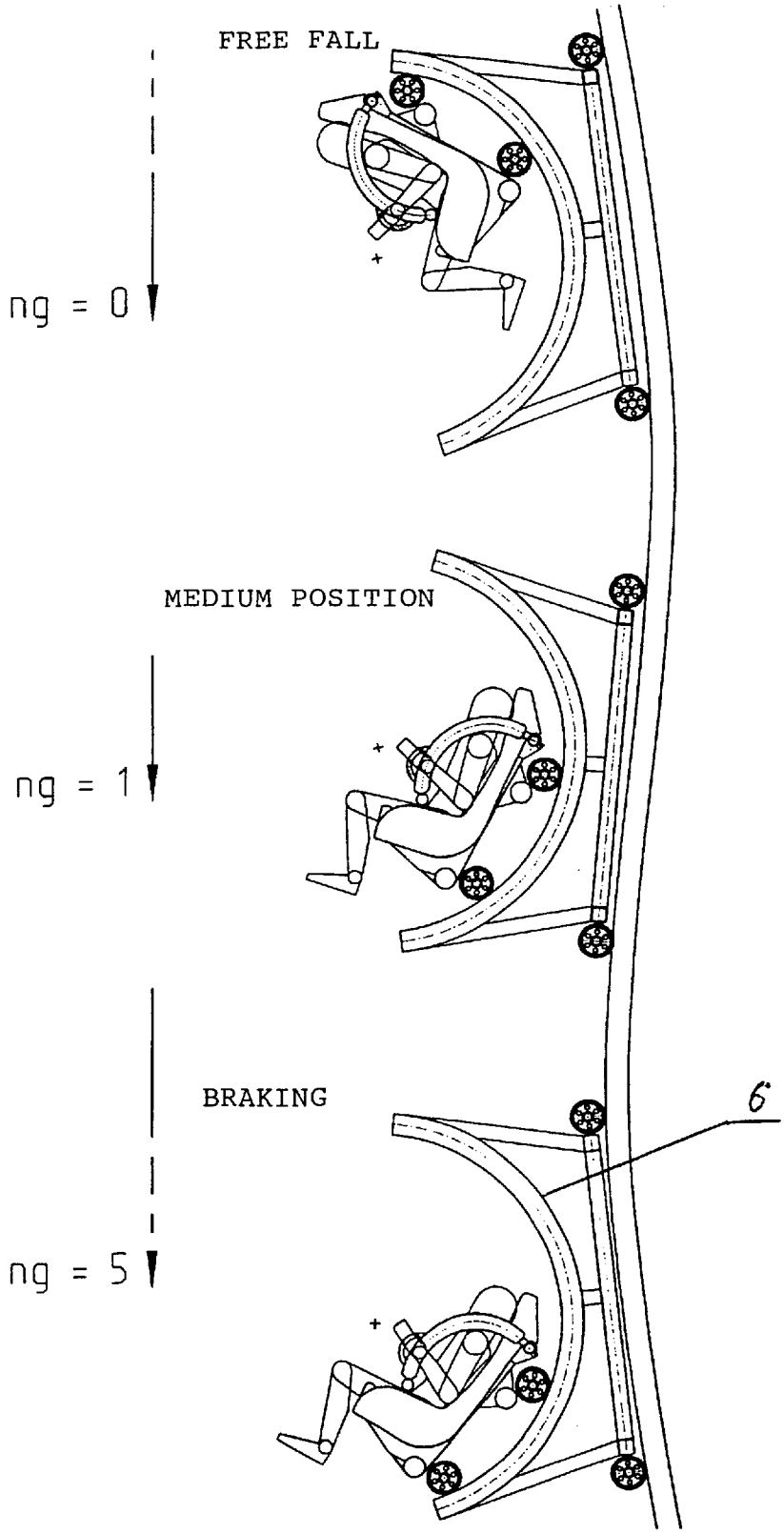
FIG. 5 Positioning of the passenger seat when curvilinear guides are used.

The invention comprises the following basic units: guide elements 1, car 2, passenger seat 3, and a return device.

Passenger seat 3 can be linked to the car rigidly or movably. The movable connection can be made in the shape of hinge 4 and the return device in the shape of elastic element 5.

Curvilinear guides 6 rigidly fastened on car 2 may be used in place of the hinge.

One can use guides 7 hinged on the car and the return device formed by elastic elements 8 and 9 fastened on the car and respectively connected with guides 7 and passenger seat 3.

Passenger seat 3 can be linked with the car by lever 10, which is connected with elastic elements 11 and 12 forming the return device and respectively connected with the car and passenger seat.

Passenger seat 3 can be linked with levers 13 and 14 fixed on the car, with lever 13—directly and with lever 14—through an intermediate hinge link 15.

Elastic element 16 is connected with lever 14.

To provide complex motion of the passenger seat, one can use rectilinear (vertical) guides 17, as well as a hinge connection in the shape of axle 18, on which the passenger seats are fastened pivotally.

Axle 18 is located perpendicular to the longitudinal axis of the guide elements.

The suggested engineering solution works in the following way.

The basis of the invention is the mobile connection of seat 3 with car 2, which can be a hinge, hinge-lever, or made with the application of guides, which makes it possible along with other parts and units structural peculiarities to attain astonishing thrills and to render the ride more diverse.

The application, along with mobile fastening shown in FIGS. 4, 5, 7, 8, and 10, of the return device, which can be executed in any shape, ensures entertainment effects and enhances the safety of passengers by reducing the force acting on the body (spine) under G-loads.

The arising forces are shown in FIGS. 1, 3–5, 7, 8, and 10 hen the car moves upward, the passenger first experiences acceleration, and the seat occupies an inclined (semi-reclining) position. That position is the best for a human body. Then the established motion mode sets in, during which the seta under the action of the return device may resume the neutral position. At the end of ascent the movement is slowed down, and the passenger due to the seat turning upward hovers above the ground experiencing a gliding effect.

Prior to the free fall start, the seat can resume the initial position and in the course of the free all it can again pass to the hovering mode. While falling the seat may take up the neutral position, and when braking—the inclined position, which is optimal for the human body subjected to the action of G-loads. Prior to the passengers unloading, the seat is returned to the initial (vertical) position.

Another distinctive feature of the invention is the possibility for the ride guest to choose a car with a particular fastening of the seats, which presents certain financial advantages since the same guest will be tempted to ride a number of times.

A ride with curvilinear guide elements can provide an even greater thrill.

Figure 6:
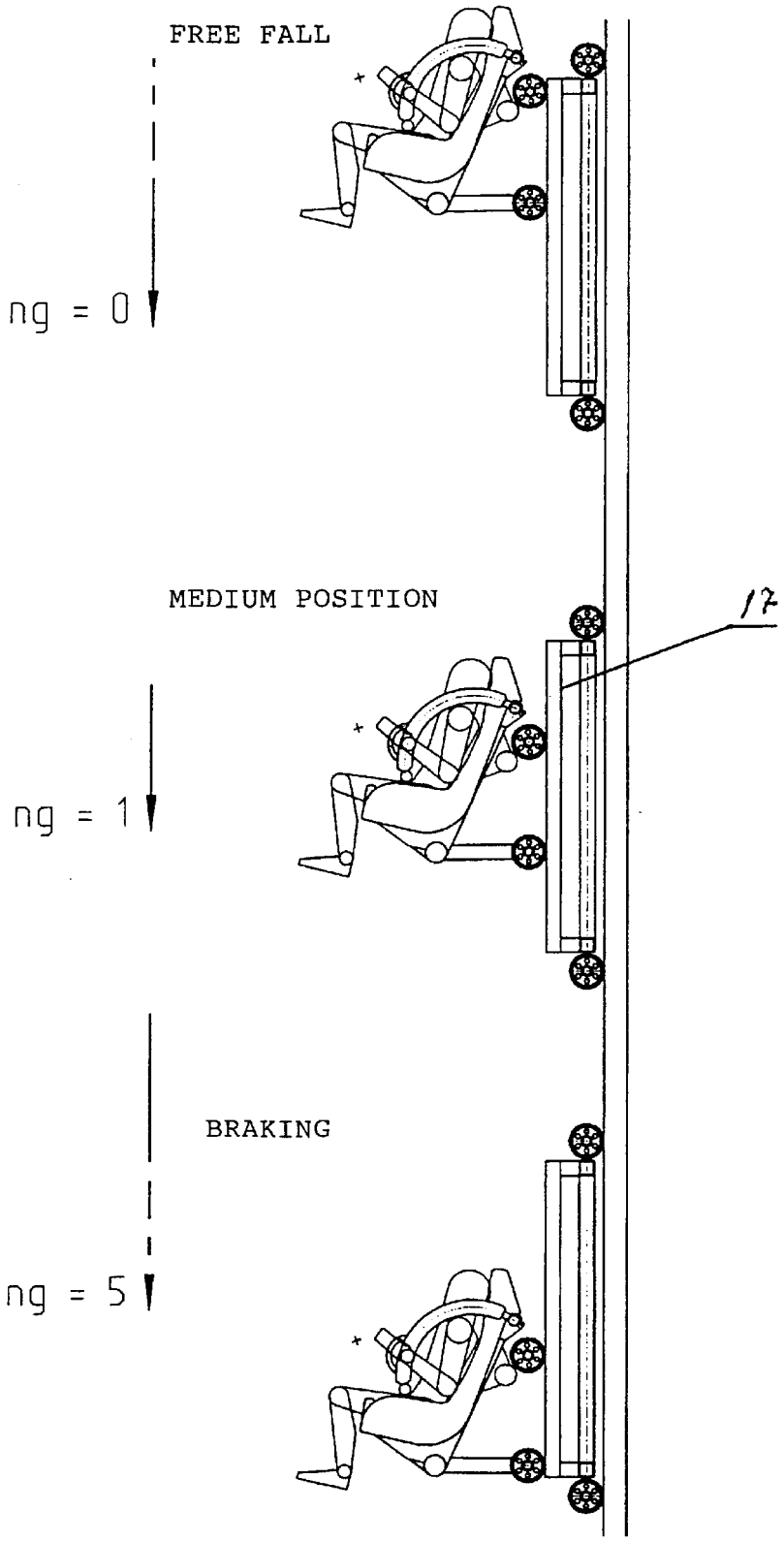
FIG. 6 The same when rectilinear guides are used.
Figure 7:
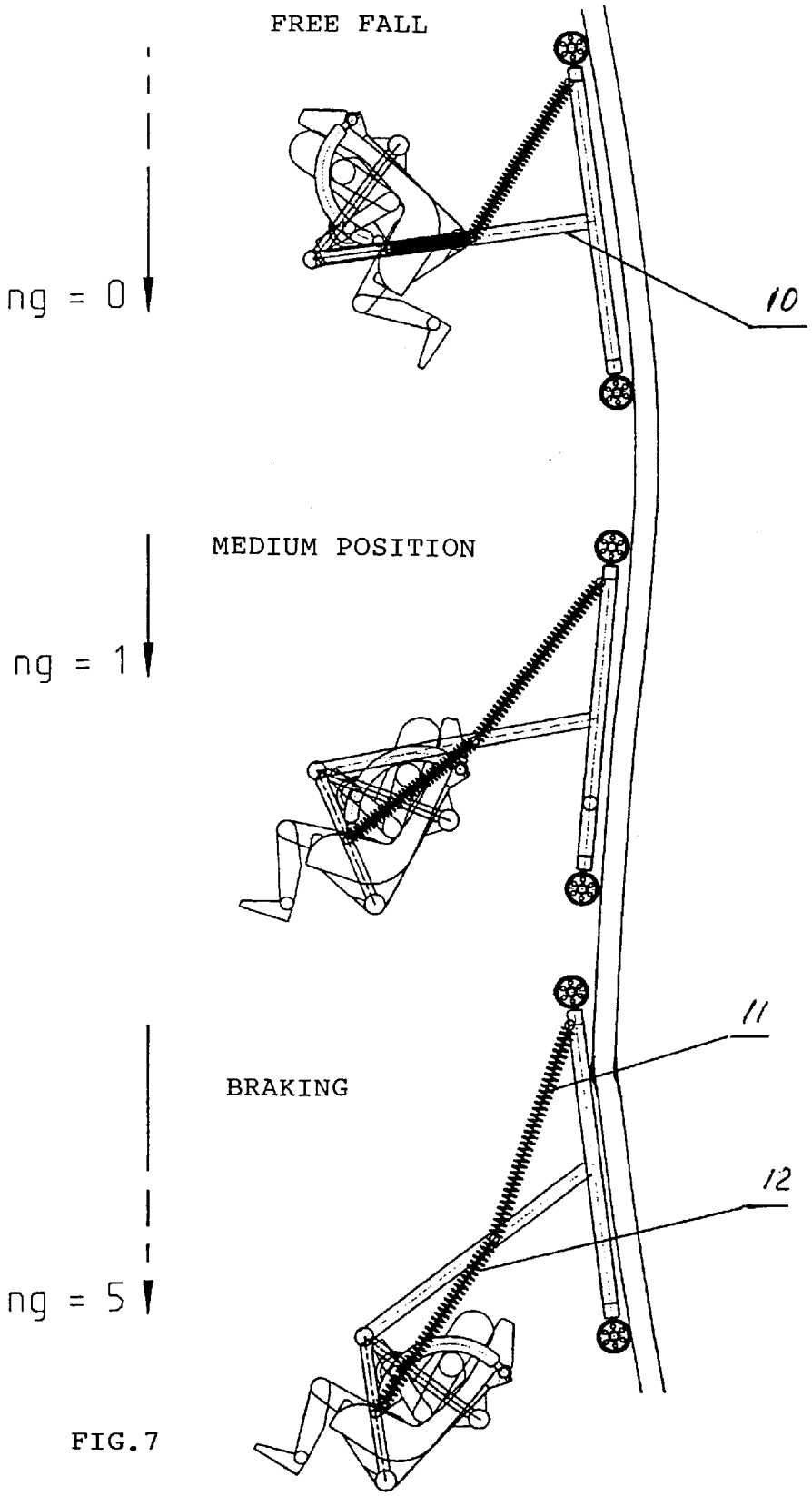
FIG. 7 Positioning of the passenger seat when a hinge-lever mechanism with one lever is used.
Figure 8:
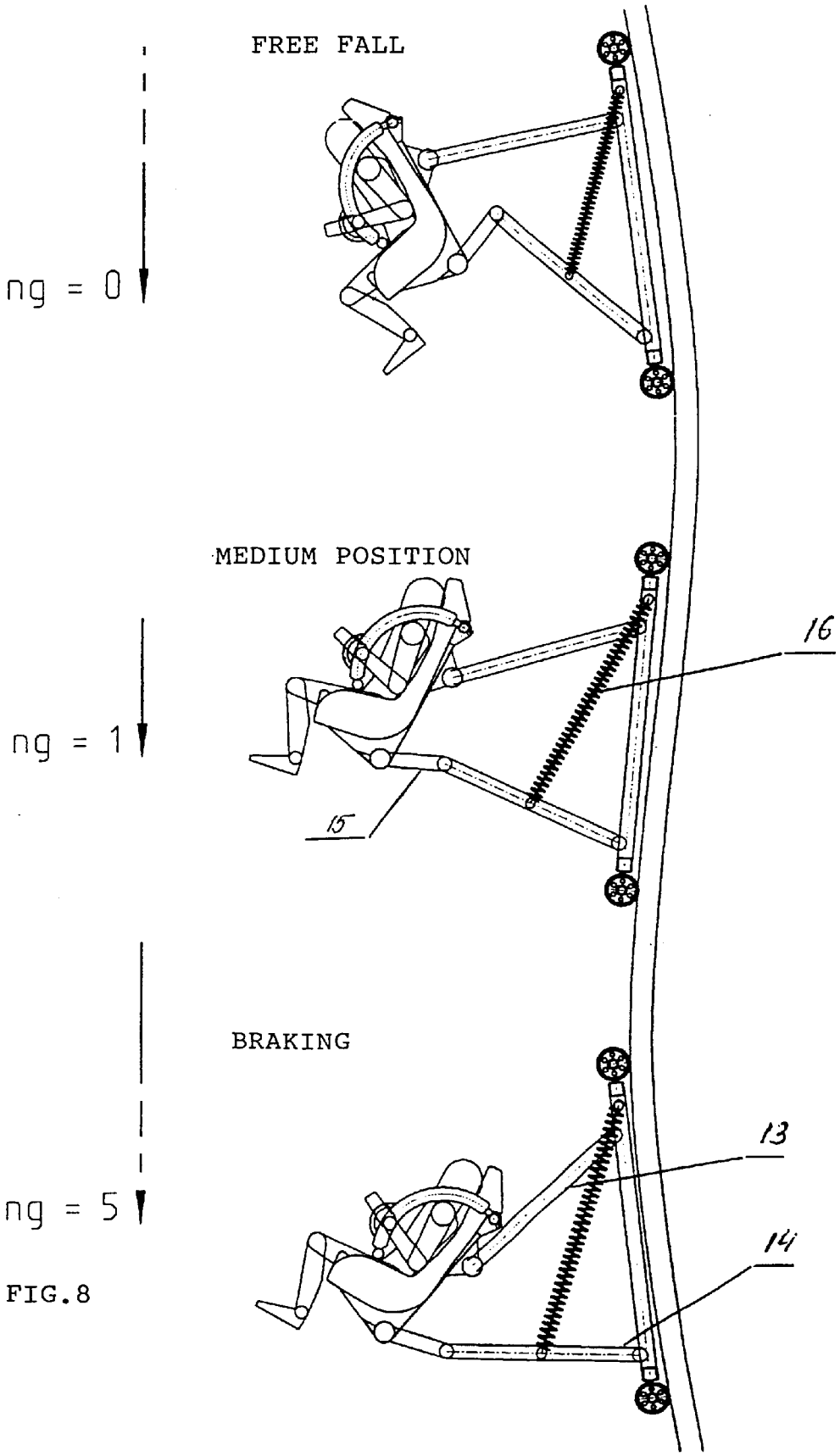
FIG. 8 Positioning of the passenger seat when another version of the hinge-lever mechanism is used.

When rectilinear guides (FIG. 6) are used, an effect of the seat 3 separation from the car is created, which is enhanced during braking.

Figure 9:
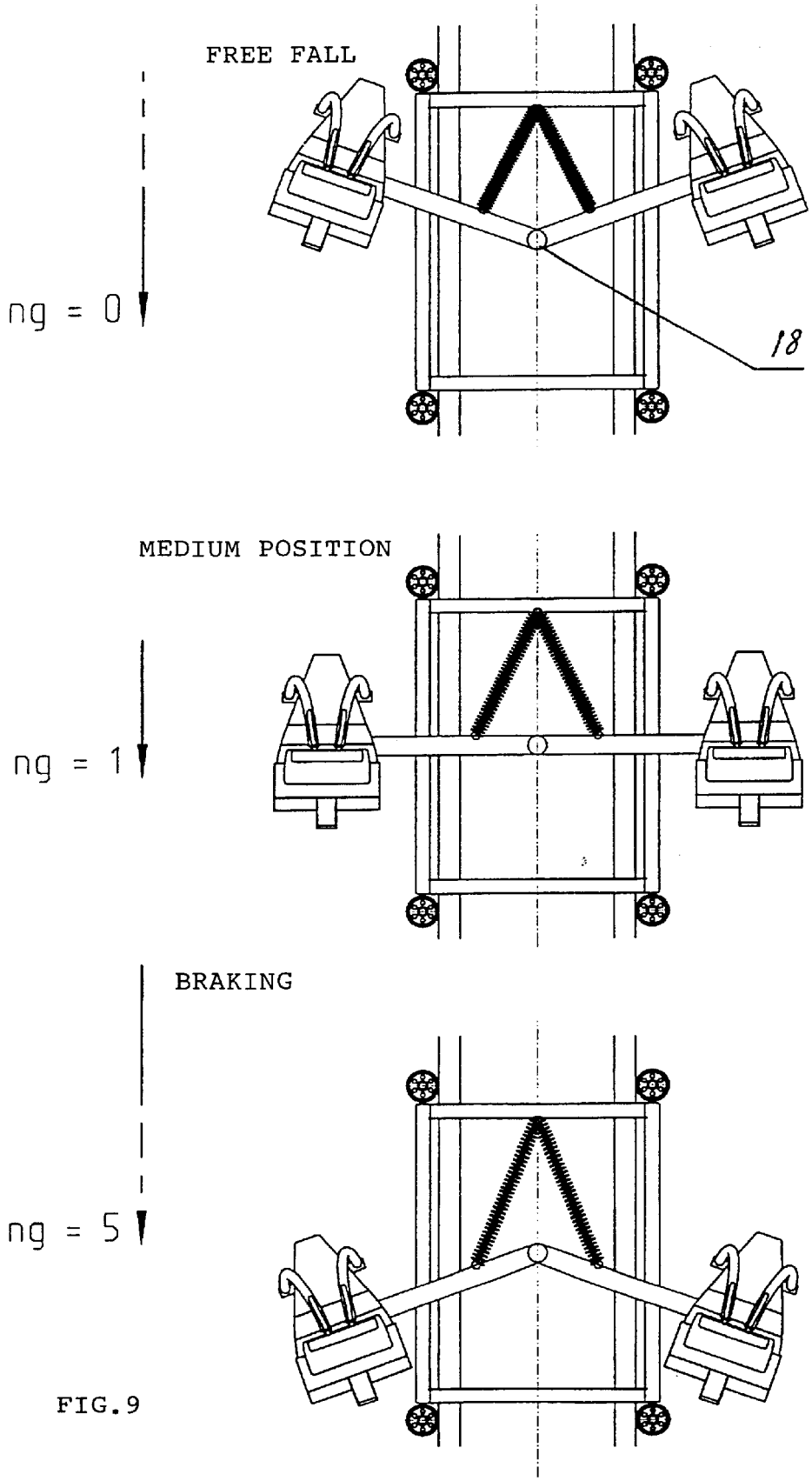
FIG. 9 Fastening of the passenger seats on the azis perpendicular to the longitudinal axis of the guide elements.
Figure 10:
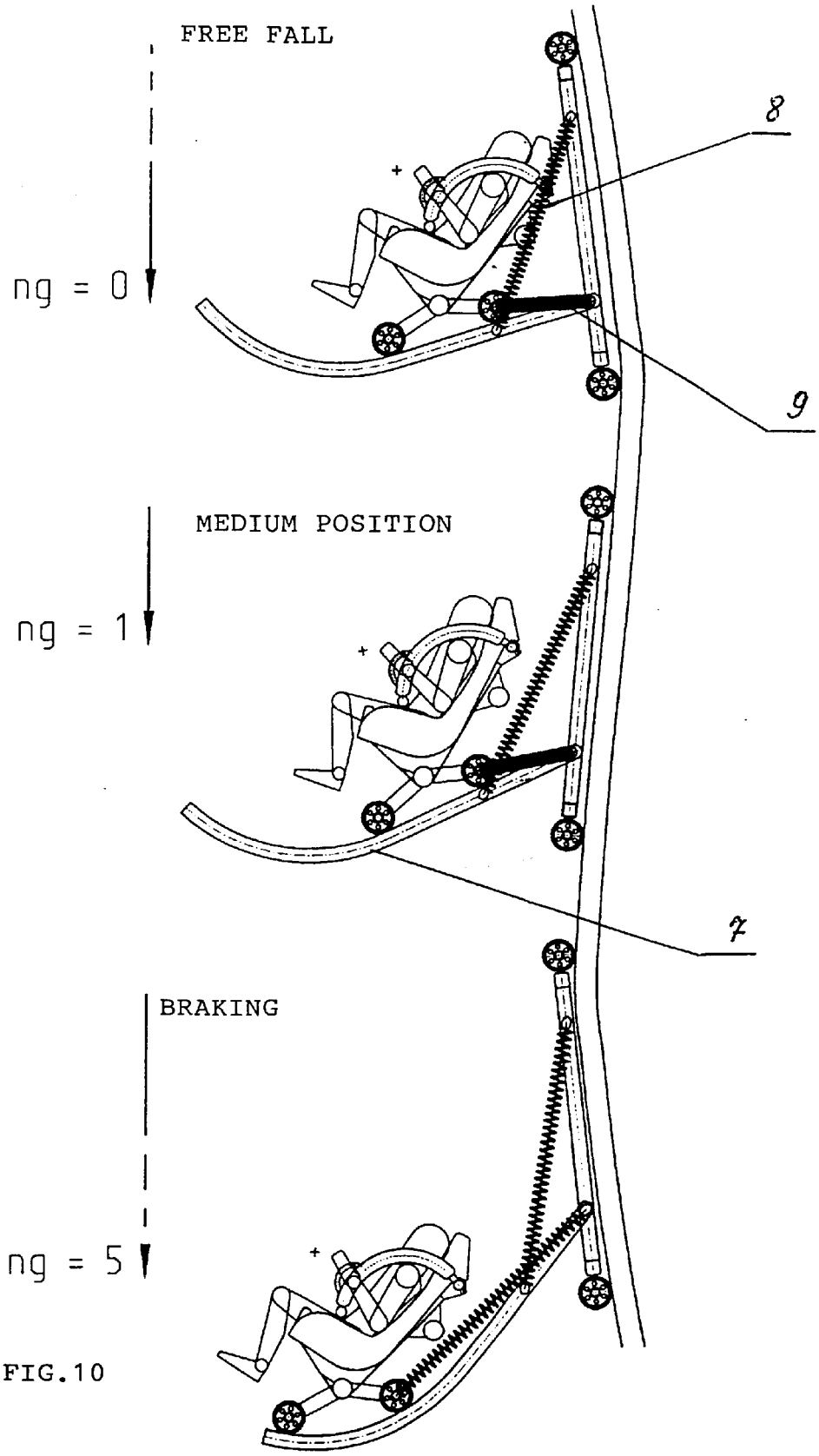
FIG. 10 Positioning of the passenger seat when a mobile fastening of the guide is used.

FIG. 9 shows how entertainment effects are provided on the basis of creation of the rocking motion of the passenger seats in the course of the car movement.

What is claimed is:

1. An amusement ride, comprising a plurality of cars; means for guiding said cars in a substantially vertical direction so that said cars are liftable and lowerable; a passenger seat provided in each of said cars; and means for cooperating said passenger seat with a respective one of said cars so that said seat is freely moving in a non-motorized way relative to said car whereby a user sitting in said seat obtains a plurality of inclined positions relative to a respective one of said cars.

2. An amusement ride as defined in claim 1, wherein said cooperating means is formed so that in a top position of a respective one of said cars said seat occupies an inclined position which is inclined in one direction, in a medium position when said at least one car is lowered said seat occupies a neutral position, and in a lowest position of said car said seat occupies an inclined a position which is inclined in another direction and provides braking of said seat.

3. An amusement ride as defined in claim 1, wherein said cooperating means include lever means which connect said seat with said car.

4. An amusement ride as defined in claim 1, wherein each of said cars has a frame, said cooperating means including a curved guide provided on said frame of each of said cars and providing a free turning said seat relative to said car.

5. An amusement ride as defined in claim 4, wherein said curve guide has a proximal portion which is close to said frame of said car and a distal portion which is spaced from said frame of said car, said distal portion being curved substantially upwardly to provide said inclined position in an opposite direction for braking said seat.

6. An amusement ride as defined in claim 1, wherein each of said cars has a frame, said seat being movable away from said frame; and further comprising means for returning said seat toward said frame, said returning means being formed as elastic means.

7. An amusement ride as defined in claim 6, wherein said elastic means is formed as spring means.

* * * * *